US007178323B2

(12) United States Patent
Kolmes et al.

(10) Patent No.: US 7,178,323 B2
(45) Date of Patent: Feb. 20, 2007

(54) MULTI-COMPONENT YARN, METHOD OF MAKING AND METHOD OF USING THE SAME

(75) Inventors: Nathaniel Kolmes, Conover, NC (US); Fred E. Driver, Ronda, NC (US)

(73) Assignee: Supreme Elastic Corporation, Conover, NC (US)

( * ) Notice: Subject to any disclaimer, the term of this patent is extended or adjusted under 35 U.S.C. 154(b) by 0 days.

(21) Appl. No.: 11/087,513

(22) Filed: Mar. 24, 2005

(65) Prior Publication Data

US 2006/0213173 A1 Sep. 28, 2006

(51) Int. Cl.
*D02G 3/22* (2006.01)

(52) U.S. Cl. ..... 57/210

(58) Field of Classification Search ..... 57/210, 57/224, 229, 230, 244, 249
See application file for complete search history.

(56) References Cited

U.S. PATENT DOCUMENTS 6,212,914 B1 * 4/2001 Kolmes et al. ..... 66/172 R
6,341,483 B1 * 1/2002 Kolmes et al. ..... 57/249
6,349,531 B1 * 2/2002 Kolmes et al. ..... 57/229
6,367,290 B2 * 4/2002 Kolmes et al. ..... 66/172 R
6,381,940 B1 * 5/2002 Kolmes et al. ..... 57/245

OTHER PUBLICATIONS

International Preliminary Search Report, Mailed Jul. 12, 2006 for PCT/US06/10683.

* cited by examiner

*Primary Examiner*—Shaun R. Hurley
(74) *Attorney, Agent, or Firm*—Oblon, Spivak, McClelland, Maier & Neustadt, P.C.

(57) ABSTRACT

A combined yarn is provided containing a metallic strand and a non-metallic strand, wherein the metallic and non-metallic strands are combined by air interlacing the filaments or fibers of the non-metallic strand at intermittent points along their length, so that the metallic strand is encased in the non-metallic strand at least at some of the intermittent points; a composite yarn incorporating the combined yarn as at least one component, and articles and/or garments made from the combined yarn or composite yarn, and methods for the production of the combined and composite yarns.

31 Claims, 5 Drawing Sheets

MULTI-COMPONENT YARN, METHOD OF MAKING AND METHOD OF USING THE SAME

BACKGROUND OF THE INVENTION

1. Field of Invention

The present invention relates to the field of combined yarns including a metallic component that are preferably cut and/or abrasion resistant, to composite yarns including such combined yarns, and to the application of air interlacing technology to the manufacture of such combined yarns.

2. Discussion of the Background

The present invention relates to yarns useful in the manufacture of various types of protective garments such as cut and puncture resistant gloves, aprons, and glove liners, and in particular to composite yarns useful for the manufacture of these garments that include a metallic strand as a part of the yarn construction.

Composite yarns that include a metallic yarn component, and cut-resistant garments prepared therefrom are known in the prior art. Representative patents disclosing such yarns include U.S. Pat. Nos. 4,384,449 and 4,470,251. U.S. Pat. No. 4,777,789 describes composite yarns and gloves prepared from the yarns, in which a strand of wire is used to wrap the core yarn. The core components of these prior art composite yarns may be comprised of cut-resistant yarns, non-cut resistant yarns, fiberglass and/or a metallic strand, such as stainless steel. One or more of these components may also be used in one or more cover yarns that are wrapped around the core yarn.

It is well known in the art to manufacture such composite yarns by combining an inherently cut-resistant yarn with other strands using wrapping techniques. For example, these yarns may use a core construction comprising one or more strands that are laid in parallel relationship or, alternatively, may include a first core strand that is overwrapped with one or more additional core strands. These composite yarns can be knit on standard glove-making machines with the choice of machine being dependent, in part, on the yarn size.

Wrapping techniques are expensive because they are relatively slow and often require that separate wrapping steps be made on separate machines with intermediate wind up steps. Further, those techniques require an increased amount of yarn per unit length of finished product depending on the number of turns per inch used in the wrap. Generally, the greater the number of turns per inch, the greater the expense associated with making the composite yarn. When the yarn being wrapped is high performance fiber, this cost may be high.

Knitted gloves constructed using a relatively high percentage of high performance fibers do not exhibit a soft hand and tend to be stiff. This characteristic is believed to result from the inherent stiffness of the high performance fibers. It follows that the tactile response and feedback for the wearer is reduced. Because these gloves typically are used in meat-cutting operations around sharp blades, it would be desirable to maximize these qualities in a cut-resistant glove.

The use of a stainless steel or other wire strand, as at least a part of the core yarn, provides enhanced cut resistance in garments, such as gloves. However, various disadvantages of prior art composite yarns incorporating a stainless steel or other wire strand have been noted. For example, there has been, with prior art yarn construction techniques, a risk of breakage of some of the wire strands, resulting in exposed wire ends that can penetrate the user's skin.

Also, during knitting, the wire component of the yarn tends to kink and form knots when subjected to the forces normally incurred during knitting. Wire strands alone cannot be knitted for this reason. While the problem is somewhat lessened by combining the wire strand or strands with other fibers as taught in the prior art, the wire component still tends to kink, knot or break, thereby lessening its usefulness in cut-resistant garments.

Processes involving treatment of yarns with air jets are well-known in the prior art. Some of these treatments are used to create textured yarns. The term "texturing" refers generally to a process of crimping, imparting random loops, or otherwise modifying continuous filament yarn to increase its cover, resilience, warmth, insulation, and/or moisture absorption. Further, texturing may provide a different surface texture to achieve decorative effects. Generally, this method involves leading yarn through a turbulent region of an air-jet at a rate faster than it is drawn off on the exit side of the jet, e.g., overfeeding. In one approach, the yarn structure is opened by the airjet, loops are formed therein, and the structure is closed again on exiting the jet. Some loops may be locked inside the yarn and others may be locked on the surface of the yarn depending on a variety of process conditions and the structure of the air-jet texturizing equipment used. A typical airjet texturizing devices and processes is disclosed in U.S. Pat. No. 3,972,174.

Another type of airjet treatment has been used to compact multifilament yarns to improve their processibility. Flat multifilament yarns are subjected to a number of stresses during weaving operations. These stresses can destroy interfilament cohesion and can cause filament breakages. These breakages can lead to costly broken ends. Increasing interfilament cohesion has been addressed in the past by the use of adhesives such as sizes. However, air compaction has enabled textiles processors to avoid the cost and additional processing difficulties associated with the use of sizes. The use of air compaction for high strength and non-high strength yarns is disclosed in U.S. Pat. Nos. 5,579,628 and 5,518,814. The end product of these processes typically exhibits some amount of twist.

Other prior art, such as U.S. Pat. Nos. 3,824,776; 5,434,003 and 5,763,076, and earlier patents referenced therein, describe subjecting one or more moving multifilament yarns with minimal overfeed to a transverse air jet to form spaced, entangled sections or nodes that are separated by sections of substantially unentangled filaments. This intermittent entanglement imparts coherence to the yarn, avoiding the need for twisting of the yarns. Yarns possessing these characteristics are sometimes referred to in the prior art as "interlaced" yarns, and at other times as "entangled" yarns.

While intermittent air entanglement of multifilament yarns has been used to impart yarn coherence, the application of this technology to combining yarns including a cut resistant yarn component and a wire component has not been recognized except in U.S. Pat. No. 6,381,940. This U.S. patent requires the use of two separate multi-filament yarns combined with one or more metal strands. The two separate multi-filament yarns are combined around the metal strand (s) by air-interlacing. However, in order to provide adequate coverage of the one or more metal strands, this patent requires the use of at least two non-metallic strands during the air-interlacing process. Thus, there is still a need for a composite yarn that includes a wire component that does not significantly kink and form knots during knitting, combined with only a single multifilament or spun yarn, and for the resultant yarns and garments manufactured therefrom.

SUMMARY OF THE INVENTION

Accordingly, one object of the present invention is to provide a combined yarn having a combination of soft feel and improved cut and/or abrasion resistance.

A further object of the present invention is to provide a composite yarn having a core formed of the combined yarn of the present invention.

Another object of the present invention is to provide garments formed from the combined yarn or composite yarn of the present invention.

These and other objects of the present invention, either individually or in combinations of two or more thereof, have been satisfied by the discovery of a combined yarn comprising:

i) at least one metallic strand; and ii) a non-metallic strand;

wherein the non-metallic strand is a multifilament strand or spun strand and wherein filaments or fibers of the non-metallic strand are air interlaced with each other at intermittent areas along the lengths of the filaments or fibers, and the metallic strand being encased within the non-metallic strand along at least a part of the length of the metallic strand;

and composite yarns incorporating the combined yarn as a component thereof, garments and articles made from the combined yarn and/or composite yarn and a method for production of the combined yarn.

BRIEF DESCRIPTION OF THE DRAWINGS

The above and other objects, features, and advantages of the present invention will be more clearly understood from the following detailed description taken in conjunction with the accompanying drawings, in which.

DETAILED DESCRIPTION OF THE INVENTION

Figure 1:
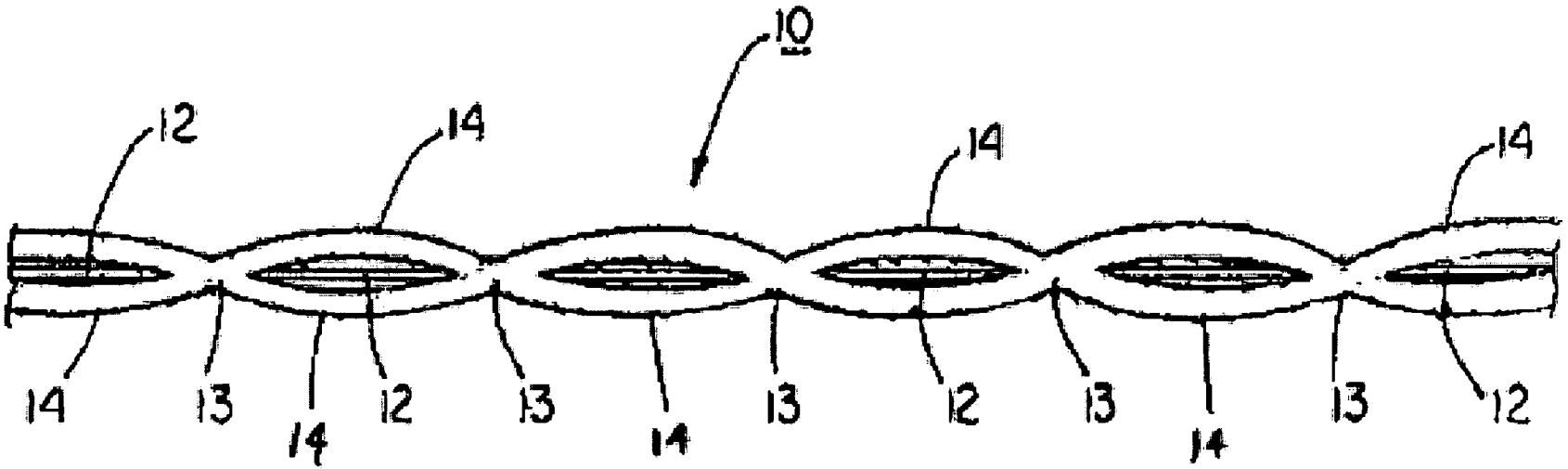
FIG. 1 is a schematic representation of the structure of the combined yarn of the present invention.

The term "fiber" as used herein refers to a fundamental component used in the assembly of yarns and fabrics. Generally, a fiber is a component which has a length dimension which is much greater than its diameter or width. This term includes ribbon, strip, staple, and other forms of chopped, cut or discontinuous fiber and the like having a regular or irregular cross section. "Fiber" also includes a plurality of any one of the above or a combination of the above.

As used herein, the term "high performance fiber" means that class of synthetic or natural non-glass fibers having high values of tenacity greater than 10 g/denier, such that they lend themselves for applications where high abrasion and/or cut resistance is important. Typically, high performance fibers have a very high degree of molecular orientation and crystallinity in the final fiber structure.

The term "filament" as used herein refers to a fiber of indefinite or extreme length such as found naturally in silk. This term also refers to manufactured fibers produced by, among other things, extrusion processes. Individual filaments making up a fiber may have any one of a variety of cross sections to include round, serrated or crenular, bean-shaped or others.

The term "yarn" as used herein refers to a continuous strand of textile fibers, filaments or material in a form suitable for knitting, weaving, or otherwise intertwining to form a textile fabric. Yarn can occur in a variety of forms to include a spun yarn consisting of staple fibers usually bound together by twist; a multi filament yarn consisting of many continuous filaments or strands; or a mono filament yarn which consist of a single strand.

The term "air interlacing" as used herein refers to subjecting either the filaments of a multifilament yarn or the fibers of a spun yarn to an air jet to combine the filaments/fibers at intermittent points along their length and thus form a single, intermittently commingled strand. This treatment is sometimes referred to as "air tacking." This term does not refer to well known air texturizing performed to increase the bulk of single yarn or multiple yarn strands. Methods of air interlacing in composite yarns and suitable apparatus therefore are described in U.S. Pat. Nos. 6,381,940; 6,349,531; 6,341,483; and 6,212,914, the contents of which are hereby incorporated by reference.

The term "composite yarn" refers to a yarn prepared from two or more yarns, which can be the same or different. Composite yarn can occur in a variety of forms wherein the two or more yarns are in differing orientations relative to one another. The two or more yarns can, for example, be parallel, wrapped one around the other(s), twisted together, or combinations of any or all of these, as well as other orientations, depending on the properties of the composite yarn desired. Examples of such composite yarns are provided in U.S. Pat. Nos. 4,777,789; 5,177,948; 5,628,172; 5,845,476; 6,351,932; 6,363,703 and 6,367,290, the contents of which are hereby incorporated by reference.

The term "composite fabric" is used herein to indicate a fabric prepared from two or more different types of yarn or composite yarn. The fabric construction can be any type, including but not limited to, woven, knitted, non-woven, etc. The two or more different types of yarn or composite yarn include, but are not limited to, those made from natural fibers, synthetic fibers and combinations thereof.

The term "composite article" is used herein to indicate a final article that comprises at least two different types of materials. The composite article can be prepared from a composite fabric, or can be prepared from a conventional fabric containing only one type of yarn, but is put together using a yarn or sewing thread made of a different material. Alternatively, the conventional fabric can be sewn together using a composite yarn as the sewing thread. Composite articles can be any form, including but not limited to, gloves, aprons, socks, filters, shirts, pants, undergarments, one-piece jumpsuits, etc. All of these types of articles, as well as other permutations that are readily evident to those of skill in the art, are included in the present invention definition of "composite article".

The term "encasing" or "encased", as used herein means that the air-tacked non-metallic filaments capture and hold the wire within and/or alongside the air-tacked yarn as a unitary combined yarn.

In accordance with the present invention, it has been found that composite yarns, preferably stretch-resistant composite yarns, that include a wire component can be produced by incorporating or "encasing" one or more metallic strands into a strand produced by intermittently air interlacing the filaments or fibers of a non-metallic fiber strand, wherein the non-metallic fiber strand is preferably a cut resistant material that is "stronger" than the wire strand having a higher tenacity and a greater resistance to stretching. Combining this stronger cut-resistant strand with the wire strand prevents kinking and forming of knots in the wire strand during knitting, thereby providing a yarn with the desired advantages of wire strands, without the disadvantages previously experienced.

The combined yarn of the present invention is useful alone or with other yarns in manufacturing garments, such as gloves that have surprising softness, hand and tactile response, without kinks or knots due to stretching of the wire component during garment manufacture.

The invention further relates to a method of making cut resistant combined yarns including feeding into a yarn air texturizing device (i) at least one wire strand; and (ii) a non-metallic fiber strand comprised of a multifilament or spun yarn, in order to form attachment points intermittently along the length of the filaments or fibers of the non-metallic strand thereby encasing the at least one wire strand.

The wire strand will normally be a monofilament, e.g., a single wire. During air interlacing, the non-metallic yarn fibers are whipped about by the air jet entangling the fibers of the non-metallic yarn, and forming attachment areas, points or nodes along the length of the wire. During air interlacing, the individual fibers of the non-metallic strand are interlaced with each other around the wire strand, which is normally a single filament, encasing or incorporating the wire strand within the interlaced non-metallic strand, at least in some of the zones. At other times the wire may be alongside the non-metallic strand, however since at times the non-metallic strand fibers are interlaced around the wire, the term "around" is appropriate and will be used hereinafter. As a result of the support provided by the entangled yarn fibers at the intermittent attachment points, the bending capability of the wire component is significantly increased, minimizing breakage problems previously encountered.

These combined yarns can be used alone in the manufacture of items such as cut resistant garments, or can be combined in parallel with another yarn during product manufacture. Alternatively, the combined yarns may be used as a core yarn in composite yarns, with a first cover strand wrapped about the combined strands in a first direction. A second cover strand may be provided wrapped about the first cover strand in a second direction opposite that of the first cover strand.

A yarn 10 according to the present invention is illustrated schematically in FIG. 1. For descriptive purposes, the non-metallic component of the present invention yarn will be described with respect to a multifilament yarn. However, it is to be understood that a spun yarn can be used instead, with the air-tacking of the yarn being performed on the fibers making up the spun yarn. The yarn can be used in combination with other yarn strands to make a cut resistant composite yarn and includes at least one wire strand 12 and one non-metallic strand 14 comprised of either an inherently cut resistant material or a non-cut resistant material or fiberglass. For illustrative purposes, FIG. 1 shows only two filaments of the non-metallic strand 14. It is to be understood that preferably there are a large number of such individual filaments that effectively surround the at least one wire strand 12. The filaments of strand 14 are interlaced with each other and around wire strand 12 to form attachment points 13 intermittently along the lengths of the single air-tacked strand 10. The air-interlacing is performed using well-known devices devised for that purpose. A suitable device includes the SlideJet-FT system with vortex chamber available from Heberlein Fiber Technology, Inc. This air-interlacing process itself is described in U.S. Pat. Nos. 6,381,940; 6,349,531; 6,341,483; and 6,212,914, the contents of which are incorporated by reference above.

In preparing the yarn of the present invention, a non-metallic yarn and the wire strand are introduced into the air-interlacing device. The filaments of the non-metallic yarn are exposed to a plurality of air streams such that the filaments of the yarn are uniformly intertwined with each other over the length of the yarn and around the wire. This treatment also causes intermittent interlacing of the yarn filaments to form attachment points between the filaments along their lengths. These attachment points, depending on the texturizing equipment and yarn strand combination used, are normally separated by lengths of non-interlaced filaments having a length of from about 0.125 to about 1.0 inch, although this separation distance can be varied outside of this range as desired. The number of filament strands per unit length of an interlaced strand will vary depending on variables such as the number and composition of the filaments fed into the device. The air pressure fed into the air-interlacing device should not be so high as to destroy the structure of any spun yarn used in the practice of the present invention.

The yarn embodiment of the present invention illustrated in FIG. 1 may be used alone or may be combined with other strands to create a variety of composite yarn structures. In the preferred embodiment depicted in FIG. 2, the composite yarn 20 includes combined yarn core strand 22 made according to the above described technique overwrapped with a first cover strand 24. The cover strand 24 is wrapped in a first direction about the core strand 22. A second cover strand 26 is overwrapped about the first core strand 24 in a direction opposite to that of the first core strand 24. Either of the first cover strand 24 or second cover strand 26 are wrapped at a rate sufficient to maintain the integrity of the core and any underlying wrap layers, preferably at a rate between about 3 to 16 turns per inch with a rate between about 8 and 14 turns per inch being more preferred. The number of turns per inch selected for a particular composite yarn will depend on a variety of factors including, but not limited to, the composition and denier of the strands, the type of winding equipment that will be used to make the composite yarn, and the end use of the articles made from the composite yarn.

Figure 2:
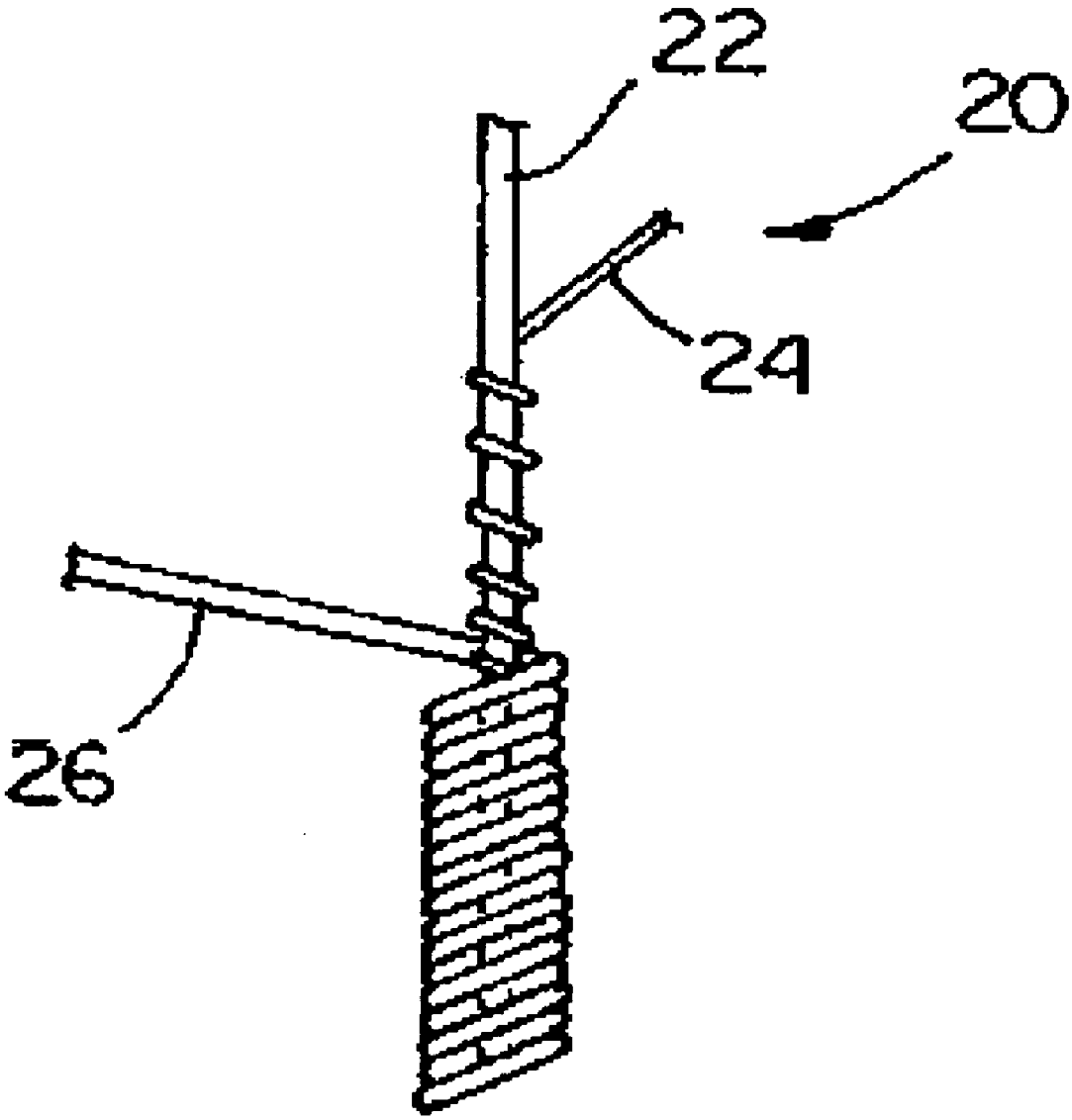
FIG. 2 is an illustration of a preferred embodiment of a composite yarn in accordance with the principles of the present invention having a single core strand of a combined yarn and two cover strands.
Figure 3:
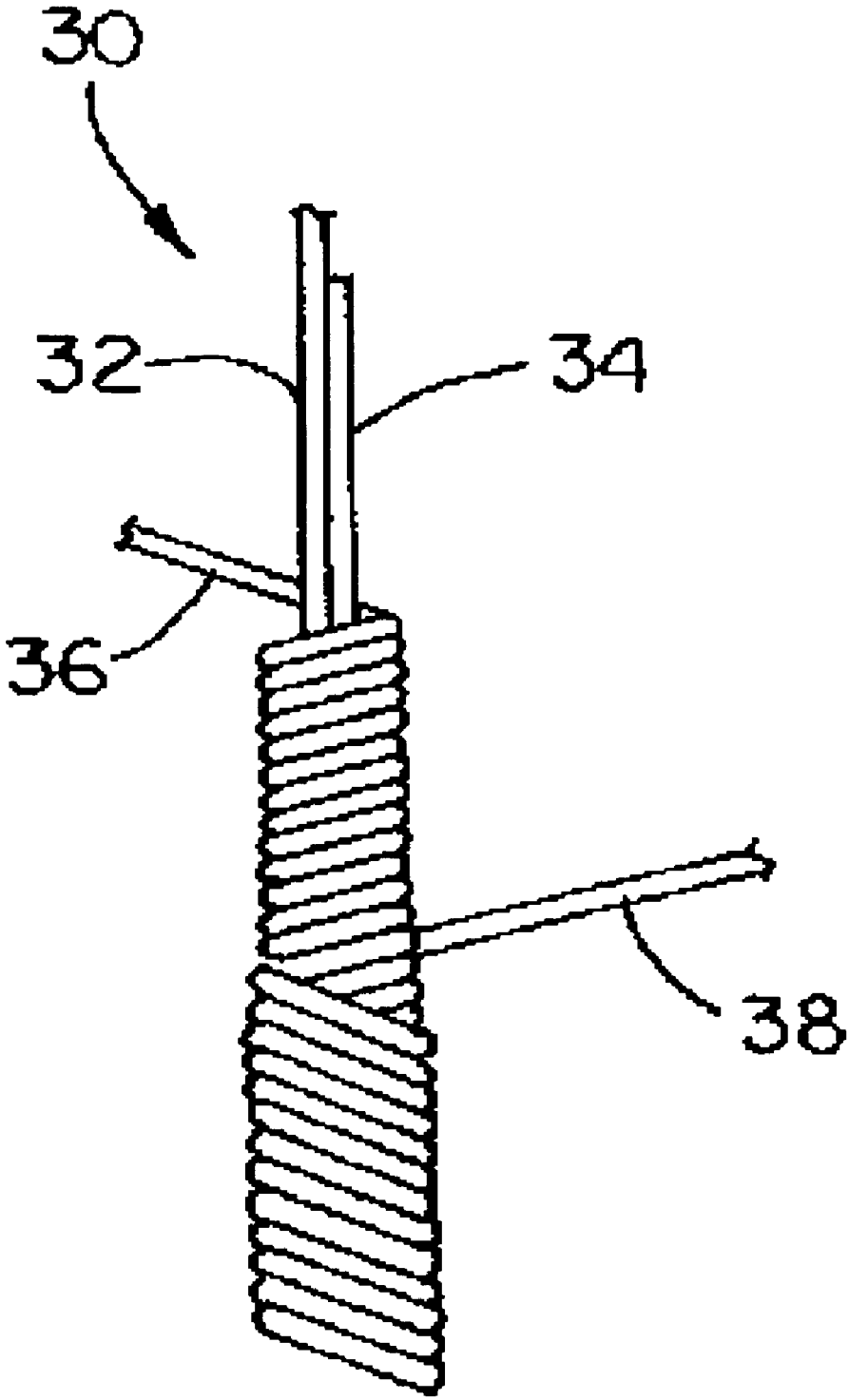
FIG. 3 is an illustration of an alternative embodiment of a composite yarn in accordance with the principles of the present invention having two core strands and two cover strands.

Turning to FIG. 3, an alternative composite yarn 30 includes a first yarn core strand 32 made in accordance to the above described technique laid parallel with a second core strand 34. This two-strand core structure is overwrapped with a first cover strand 36 in a first direction, which may be clock-wise our counter clock-wise. Alternatively, the composite yarn 30 may include a second cover strand 38 overwrapped about the first cover strand 36 in a direction opposite to that of the first cover strand 36. The selection of the turns per inch for each of the first and second cover strands 36, 38 may be selected using the same criteria described for the composite yarn illustrated in FIG. 2.

Figure 4:
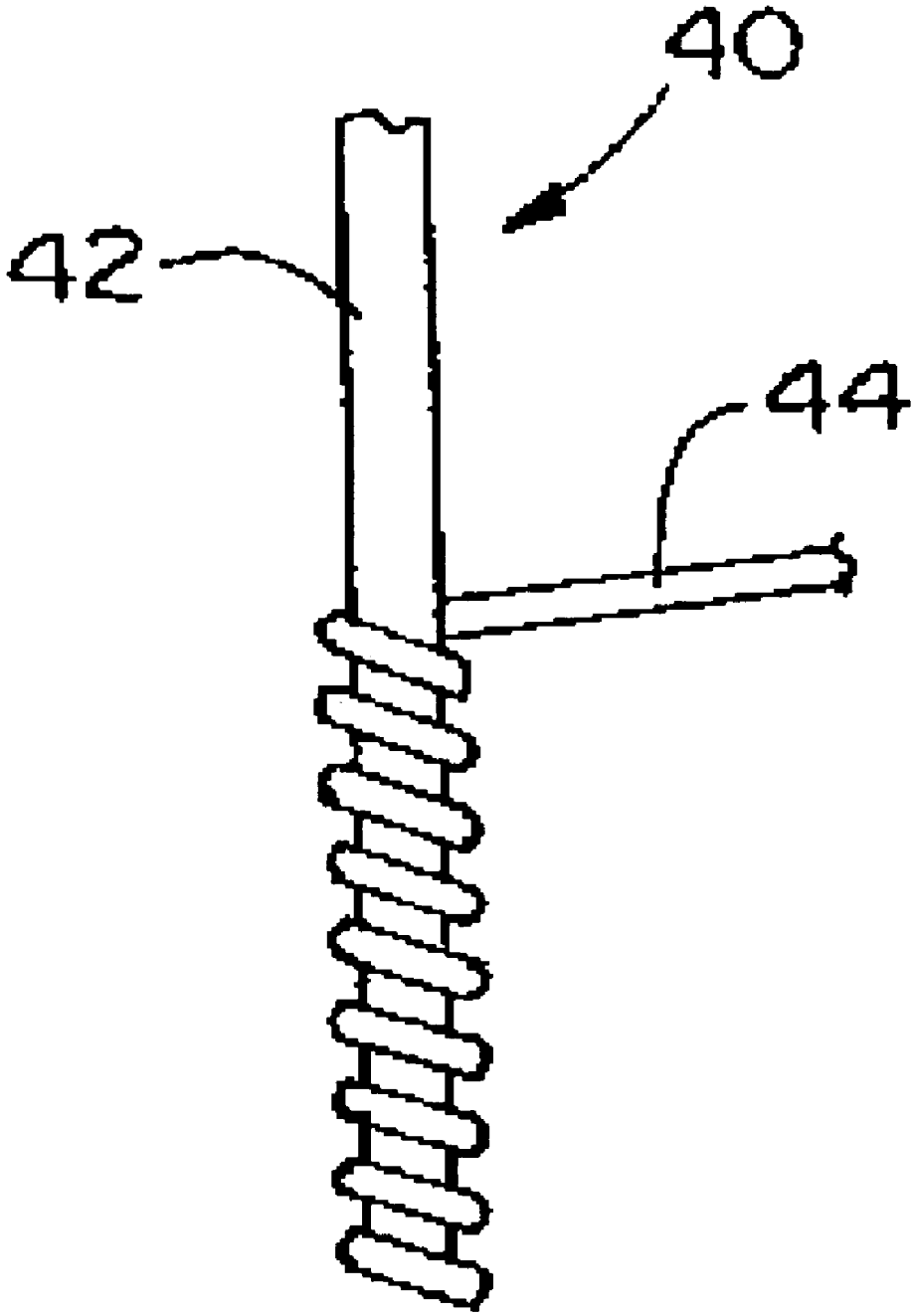
FIG. 4 is an illustration of an alternative embodiment of a composite yarn in accordance with the principles of the present invention having a single core strand and a single cover strand.

An alternative embodiment 40 is illustrated in FIG. 4. This embodiment includes a composite yarn core strand 42 made in accordance with the technique described above that has been wrapped with a single cover strand 44. This cover strand is wrapped about the core at any desired rate sufficient to maintain integrity of the underlying core and wrap layers, during processing, preferably at a rate between about 8 and 16 turns per inch. The rate will vary depending on the denier of the core and cover strands and the material from which they are constructed. It will be readily apparent that a large number of core cover combinations may be made depending on the yarn available, the characteristics desired in the finished goods, and the processing equipment available. For example, more than two strands may be provided in the core construction and more than two cover strands can be provided.

Strand 12 is constructed of a flexible metallic, preferably annealed, very fine wire. The strand is desirably of stainless steel. However, other metals, such as malleable iron, copper or aluminum, will also find utility. The wire should have a total diameter of from about 0.0008 to about 0.002 inch, and preferably from about 0.001 to about 0.0016 inch. The wire may be comprised of multiple wire filaments, with the total diameters of the filaments being within these ranges. An important feature of the present invention is the ability to combine the multifilament yarn with the wire strand using the air-interlacing process, without the need to use two or more yarns (at least one being multifilament) as required in U.S. Pat. No. 6,381,940. This is primarily made possible in the present invention by the discovery that using a very small diameter metallic wire strand within the range of diameters noted above, permits the use of a single multifilament strand in encasing the wire and providing a usable final combined yarn.

The non-metallic strand 14 may be an inherently cut resistant strand constructed from high performance fibers well known in the art. These fibers include, but are not limited to an extended-chain polyolefin, preferably an extended-chain polyethylene (sometimes referred to as "ultrahigh molecular weight polyethylene"), such as SPECTRA fiber manufactured by Allied Signal or DYNEEMA; an aramid, such as KEVLAR fiber manufactured by DuPont De Nemours; TWARON sold by Akzo Nobel; or TECHNORA sold by Teijin; and a liquid crystal polymer fiber such as VECTRAN fiber manufactured by Hoechst Celanese. Another suitable inherently cut resistant fiber includes CERTRAN M available from Hoechst Celanese.

These and other cut resistant fibers may be supplied in either continuous multi-filament form or as a spun yarn. Generally, it is believed that these yarns may exhibit better cut resistance when used in continuous, multi-filament form. The denier of the inherently cut resistant strand may be any of the commercially available deniers within the range between about 70 and 1200, with a denier between about 200 and 700 being preferred.

In order to prevent stretching, kinking, and forming knots of the wire component during knitting of garments, and resultant kinking and knotting of the wire, the cut-resistant yarn should be "stronger" having a higher tenacity and a greater resistance to stretching.

Alternatively, the non-metallic strand 14 may be constructed from one of a variety of non-cut resistant materials including, but not limited to, available natural and man made fibers, or fiberglass. These include, but are not limited to, polyester, nylon, acetate, rayon, cotton, and polyester-cotton blends. The manmade fibers in this group may be supplied in either continuous, multi-filament form or in spun form. The denier of these yarns may be any one of the commercially available sizes between about 70 and 1200 denier, with a denier between about 140 and 300 being preferred and a denier.

If the non-cut-resistant strand is fiberglass, it may be either E-glass or S-glass of either continuous filament or spun construction. Preferably, the fiberglass strand has a denier of between about 200 and about 2,000. Fiberglass fibers of this type are manufactured both by Corning and by PPG and are characterized by various properties such as relatively high tenacity of about 12 to about 20 grams per denier, and by resistance to most acids and alkalies, by being unaffected by bleaches and solvents, and by resistance to environmental conditions such as mildew and sunlight and highly resistant to abrasion and aging. The practice of the present invention contemplates using several different sizes of commonly available fiberglass strands, as illustrated in Table 1 below:

TABLE 1

Standard Fiberglass Sizes

| Fiberglass Size | Approximate Denier |
|---|---|
| G-450 | 99.21 |
| D-225 | 198.0 |
| G-150 | 297.6 |
| G-75 | 595.27 |
| G-50 | 892.90 |
| G-37 | 1206.62 |

The size designations in the Table are well known in the art to specify fiberglass strands. These fiberglass strands may be used singly or in combination depending on the particular application for the finished article. By way of non-limiting example, if a total denier of about 200 is desired for the fiberglass component of the core, either a single D-225 or two G-450 strands may be used. Suitable fiberglass strands are available from Owens-Corning and from PPG Industries.

The cover strands in the embodiments depicted in FIGS. 2–4 may be comprised of either wire strands, inherently cut resistant materials, non-cut resistant materials, fiberglass, or combinations thereof, depending on the particular application. For example, in the embodiments having two cover strands, the first cover strand may be comprised of an inherently cut resistant material and the second cover strand may be comprised of a non-cut resistant material such as nylon or polyester. This arrangement permits the yarn to be dyed or to make a yarn that will create particular hand characteristics in a finished article.

In the illustrated embodiments, the wire stand enhances cut resistance of the yarn. Advantageously, these affects are achieved without the time and expense of wrapping the wire around the high performance fiber or vice versa.

Alternatively, the yarn of the present invention can be used as a wrap layer in a conventional composite yarn if desired, rather than as the core as described above. In a further embodiment, the core of a composite yarn can be formed of the present invention yarn, and one or more of the wrap layers can also be made of the present invention yarn.

The following examples demonstrate the variety of the combined yarns and composite yarns that may be constructed using the combined yarn components of the present invention. The specific composite yarn components illustrate the invention in an exemplary fashion and should not be construed as limiting the scope of the invention.

Exemplary embodiments of the combined yarn include, but are not limited to:

Combined Yarn 1: 215 denier SPECTRA combined with 0.0016 ga stainless steel wire Combined Yarn 2: 375 denier SPECTRA combined with 0.0016 ga stainless steel wire Combined Yarn 3: G-37 fiberglass combined with 0.003 ga stainless steel wire Combined Yarn 4: G-37 fiberglass combined with 0.002 ga stainless steel wire Combined Yarn 5: 650 denier SPECTRA combined with 0.0035 ga stainless steel wire Combined Yarn 6: 1000 denier KEVLAR combined with 0.002 ga stainless steel wire Combined Yarn 7: 600 denier KEVLAR combined with 0.0016 ga stainless steel wire Combined Yarn 8: 200 denier KEVLAR combined with 0.0016 ga stainless steel wire Combined Yarn 9: 1500 denier KEVLAR combined with 0.002 ga stainless steel wire Combined Yarn 10: 30/1 spun KEVLAR combined with 0.0016 ga stainless steel wire Combined Yarn 11: 200 denier KEVLAR combined with 0.002 ga stainless steel wire Combined Yarn 12: 220 denier flat PET combined with 0.002 ga stainless steel wire Combined Yarn 13: 20/2 spun KEVLAR combined with 0.0016 ga stainless steel wire Exemplary embodiments of composite yarns incorporating such combined yarns include, but are not limited to, composite yarns having the following constructions:

Composite Yarn 1: Core: 70 denier SPANDEX
Bottom cover: 150 denier PET
Middle cover: Combined Yarn 11
Top cover: 30/1 spun KEVLAR Composite Yarn 2: Core: 70 denier SPANDEX
Bottom cover: 150 denier PET
Middle cover: Combined Yarn 12
Top cover: 30/1 spun KEVLAR Composite Yarn 3: Core: 70 denier SPANDEX
Bottom cover: 150 denier PET
Middle cover: Combined Yarn 12
Top cover: 50/1 spun DYNEEMA Alternatively, the combined yarn can be used as the Core component in a composite yarn, with conventional cover layers, or if desired, one or more cover layers also made of a combined yarn of the present invention, which may be the same or different from the combined yarn making up either the core or another cover layer.

Figure 5:
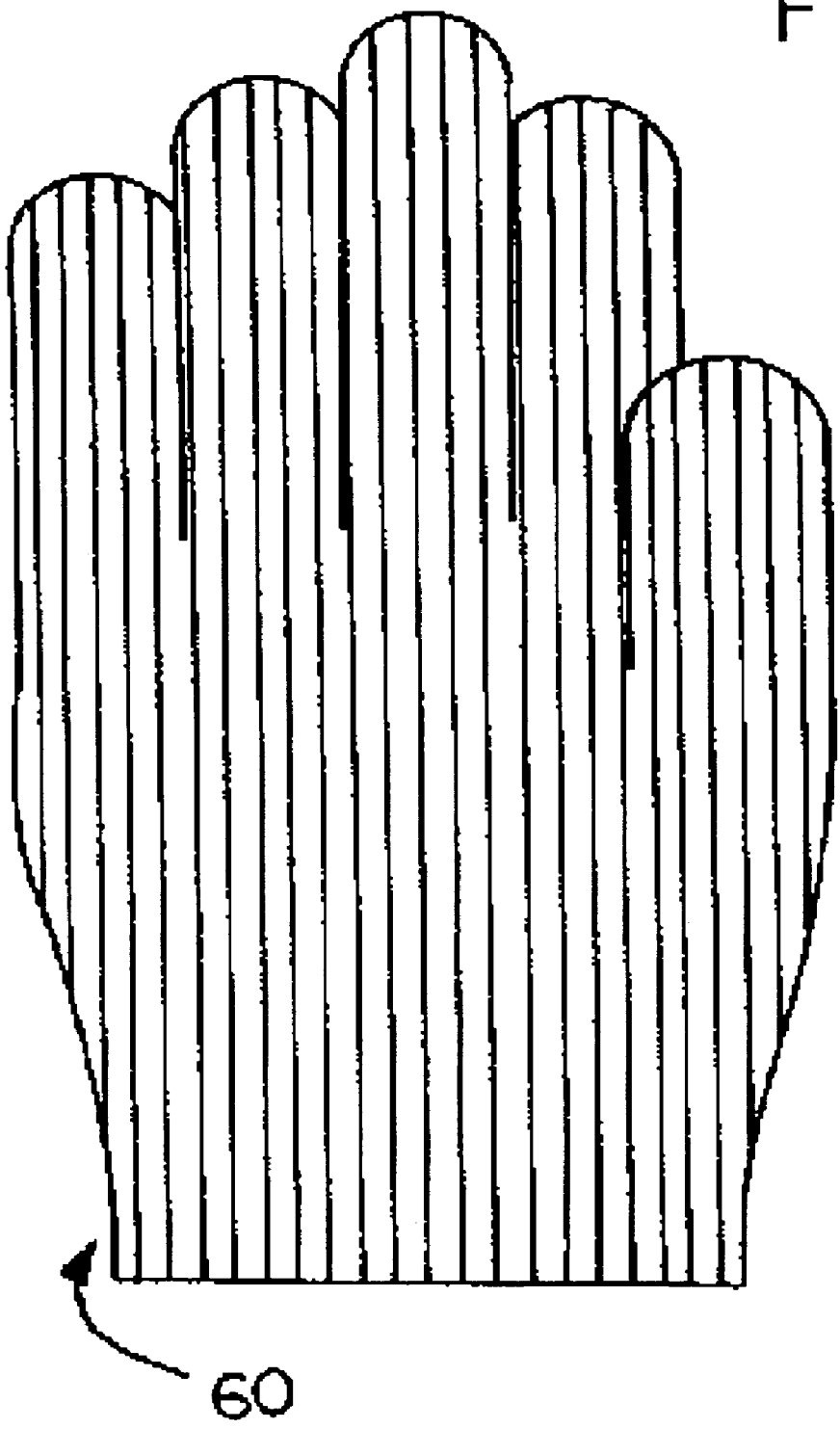
FIG. 5 is an illustration of a protective garment, namely a glove, in accordance with the principles of the present invention.

Knit gloves, as illustrated in FIG. 5, made with the present interlaced yarns are more flexible and provide better tactile response than similarly constructed gloves of conventional composite yarns in which a steel wire forms a component of the composite yarn core, and have similar levels of cut resistance. The gloves incorporating the present invention yarns have improved feel relative to gloves made from yarns according to U.S. Pat. No. 6,381,940, due to the use of smaller wire and smaller denier non-metallic yarn, thus providing even better flexibility and feel, without sacrificing the cut resistance needed in many industries. Kinking and knotting of the steel component is prevented during knitting by the greater stretch resistance of the intermittently entangled cut-resistant yarn component. Also, the steel is better protected from breakage, and the ends of the wires, if breakage should occur, are less likely to protrude from the fabric surface.

The present invention further relates to an article comprising the combined yarn or composite yarn of the present invention. Preferably, the article is a member selected from the group consisting of gloves, aprons, arm shields, jackets and sporting equipment such as fencing uniforms.

The invention claimed is:

1. A combined yarn comprising:
i) at least one metallic strand; and
ii) a single non-metallic strand;
wherein said single non-metallic strand is a multifilament strand or spun strand and wherein filaments or fibers of the single non-metallic strand are air interlaced with each other at intermittent areas along the lengths of said filaments or fibers, and said metallic strand being encased within said single non-metallic strand along at least a part of the length of said metallic strand.

2. The combined yarn of claim 1, wherein said metallic strand is of stainless steel.

3. The combined yarn of claim 1, wherein said metallic strand has a diameter of from about 0.0008 to about 0.002 inch.

4. The combined yarn of claim 1, wherein said single non-metallic strand is of a cut resistant material selected from the group consisting of ultrahigh molecular weight polyethylene, aramids, and high strength liquid crystal polymers.

5. The combined yarn of claim 1, wherein said single non-metallic strand is of a non-cut resistant material selected from the group consisting of polyester, nylon, acetate, rayon, and cotton.

6. The combined yarn of claim 1, wherein said intermittent points are spaced from about 0.125 to about 1.0 inch apart.

7. The combined yarn of claim 1, wherein said single non-metallic strand is of a cut resistant or non-cut resistant material, and has a denier of from about 70 to about 1200.

8. The combined yarn of claim 1, wherein said single non-metallic strand is of fiberglass, and has a denier of from about 200 to about 2,000.

9. A composite yarn comprising:
a) a core comprising:
i) at least one metallic strand; and
ii) a single non-metallic strand;
wherein said single non-metallic strand is a multifilament strand or spun strand and wherein filaments or fibers of the single non-metallic strand are air interlaced with each other at intermittent areas along the lengths of said filaments or fibers, and said metallic strand being encased within said single non-metallic strand along at least a part of the length of said metallic strand; and
b) a first cover strand wrapped around said core.

10. The composite yarn of claim 9, wherein said at least one first cover strand is of a material selected from the group consisting of ultrahigh molecular weight polyethylene, aramids, high strength liquid crystal polymers, polyesters, nylon, acetate, rayon, cotton, polyolefins, and fiberglass.

11. The composite yarn of claim 9, further including a second cover strand wrapped around said core and first cover in the opposite direction from said first cover strand.

12. The composite yarn of claim 9, wherein said metallic strand is of stainless steel.

13. The composite yarn of claim 9, wherein said metallic strand has a diameter of from about 0.0008 to about 0.002 inch.

14. The composite yarn of claim 9, wherein said single non-metallic strand is of a cut resistant material selected from the group consisting of ultrahigh molecular weight polyethylene, aramids, and high strength liquid crystal polymers.

15. The composite yarn of claim 9, wherein said single non-metallic strand is of a non-cut resistant material selected from the group consisting of polyester, nylon, acetate, rayon, and cotton.

16. The composite yarn of claim 9, wherein said intermittent points are spaced from about 0.125 to about 1.0 inch apart.

17. The composite yarn of claim 9, wherein said single non-metallic strand is of a cut resistant or non-cut resistant material, and has a denier of from about 70 to about 1200.

18. The composite yarn of claim 9, wherein said single non-metallic strand is of fiberglass, and has a denier of from about 200 to about 2,000.

19. The composite yarn of claim 11, wherein said second cover yarn is of a material selected from the group consisting of ultrahigh molecular weight polyethylene, aramids, high strength liquid crystal polymers, polyesters, nylon, acetate, rayon, cotton, polyolefins, and fiberglass.

20. A method of manufacturing a yarn comprising:

a) positioning at least one metallic strand adjacent a single non-metallic strand, wherein said non-metallic strand is a multifilament or spun yarn; and b) passing said at least one metallic strand and said single non-metallic strand through an air jet texturizing device where an air jet impinges against said strands at intermittent points to entangle filaments or fibers of said single non-metallic strand, thus encasing said at least one metallic strand at least at some of said intermittent points.

21. The method of claim 20, wherein said metallic strand is of stainless steel and has a diameter of from about 0.0008 to about 0.002 inch.

22. The method of claim 20, wherein said single non-metallic strand is of a material selected from the group consisting of ultrahigh molecular weight polyethylene, aramids, high strength liquid crystal polymers, polyester, nylon, acetate, rayon, cotton, and polyolefins.

23. The method of claim 20, wherein said intermittent points are spaced from about 0.125 to about 1.0 inch apart.

24. The method of claim 20, further comprising wrapping a first cover yarn in a first direction around said yarn to provide a composite yarn.

25. The method of claim 24, wherein said first cover yarn is of a material selected from the group consisting of ultrahigh molecular weight polyethylene, aramids, high strength liquid crystal polymers, polyester, nylon, acetate, rayon, cotton, polyolefins, and fiberglass.

26. The method of claim 24, further comprising wrapping a second cover yarn around said composite yarn in a direction opposite from said first cover yarn.

27. The method of claim 26, wherein said second cover yarn is of a material selected from the group consisting of ultrahigh molecular weight polyethylene, aramids, high strength liquid crystal polymers, polyester, nylon, acetate, rayon, cotton, polyolefins, and fiberglass.

28. An article comprising the yarn of claim 1.

29. The article of claim 28, wherein the article is a member selected from the group consisting of gloves, aprons, arm shields, jackets and fencing uniforms.

30. An article comprising the yarn of claim 9.

31. The article of claim 30, wherein the article is a member selected from the group consisting of gloves, aprons, arm shields, jackets and fencing uniforms.

* * * * *